US006102643A

United States Patent [19]

Pas

[11] Patent Number: 6,102,643

[45] Date of Patent: Aug. 15, 2000

[54] BINDING APPARATUS

[75] Inventor: David Pas, Antwerp, Belgium

[73] Assignee: Verhaert Design & Development N.V., Kriubeke, Belgium

[21] Appl. No.: 09/138,602

[22] Filed: Aug. 24, 1998

[30] Foreign Application Priority Data

Aug. 23, 1997 [DE] Germany ..... 197 36 819

[51] Int. Cl.[7] ..... B42B 5/06

[52] U.S. Cl. ..... 412/34

[58] Field of Search ..... 412/34, 37, 38, 412/39

[56] References Cited

U.S. PATENT DOCUMENTS

| | | | |
|---|---|---|---|
| 3,804,694 | 4/1974 | Blair | 412/34 X |
| 4,986,713 | 1/1991 | Zoltner et al. | 412/34 |
| 5,314,283 | 5/1994 | Zoltner . | |
| 5,330,229 | 7/1994 | Zoltner | 412/34 X |
| 5,915,904 | 6/1999 | Hefty | 412/34 X |

FOREIGN PATENT DOCUMENTS 2 145 033A 3/1985 United Kingdom .

*Primary Examiner*—Willmon Fridie, Jr.
*Attorney, Agent, or Firm*—Jones, Tullar & Cooper, P.C.

[57] ABSTRACT

The present invention relates to an apparatus for binding a number of sheets forming a stack along one of their edges by means of an essentially U-shaped deformable channel. The apparatus has a support for depositing horizontally the sheets to be bound, and having above the support a pressure applying device which is operable to deform the deformable channel and includes an actuating lever by means of which the pressure applying device is movable from an inoperative position into an operative position; to be able to use the apparatus universally and deform narrow and wide channels alike with optimum results, the apparatus is configured such that the pressure applying device is carried by a pivotal supporting structure and the pressure applying device is mounted for rotation on the supporting structure, wherein both the pressure applying device and the supporting structure are operable by means of the actuating lever.

17 Claims, 3 Drawing Sheets

BINDING APPARATUS

FIELD OF THE INVENTION

This invention relates to an apparatus for binding a number of sheets forming a stack along one of their edges by means of an essentially U-shaped deformable channel, the apparatus having a horizontal support for depositing the sheets to be bound and having above the support a pressure applying device which is operable to deform the deformable channel the pressure applying device including an actuating lever by means of which the pressure applying device is movable from an inoperative position into an operative position.

BACKGROUND OF THE INVENTION

From British Patent, GB 2 145 033 Ba a binding apparatus is known for binding loose sheets of paper or the like to form a booklet. For this purpose, a U-shaped channel is inserted in the binding apparatus such that the channel opening points to the side, enabling the stack of sheets needing to be bound to be introduced into this channel opening. Then a pressure applying device is pressed onto the upper side of the channel, causing the channel to be compressed such that the sheets are clenched between, and securely held by, the two channel legs. With such binding apparatus it is possible to obtain a stable booklet in a relatively simple manner. However, this binding apparatus is only suitable for use with books or channels of a particular size. The deformation of wider or narrower channels is subject to restrictions, an optimum deformation being however not possible.

SUMMARY OF THE INVENTION

It is an object of the present invention to provide a binding apparatus suitable for universal use which enables narrow and wide channels alike to be deformed optimally.

According to the present invention, this object is accomplished in that the pressure applying device is carried by a pivotal supporting structure and the pressure applying device is mounted for rotation on the supporting structure, wherein both the pressure applying device and the supporting structure are operable by means of the actuating lever.

Thus, in the binding apparatus of the present invention not only a the pressure applying device actuated for deforming the U-shaped channel but also a supporting structure is provided on which the pressure applying device is mounted. This supporting structure operates to advance the pressure applying device towards the channel to be deformed, such that only the two free legs of the channel need be compressed by means of the pressure applying device. Accordingly, by means of the supporting structure the pressure applying device is adjusted to suit the width of the channel. In this manner the binding apparatus of the present invention is in a position to bind both relatively thin and relatively thick stacks of sheets, that is, the number of sheets to be bound to form a book may be relatively low and relatively high as well. Regardless of the thickness of the stack, the respective channels are deformed optimally because the pressure applying device has been adjusted specifically to accommodate the thickness of the channel by means of the supporting structure.

In a preferred embodiment provision is made for the pressure applying device to be mounted on the free pivotal end of the supporting structure. By pivoting the free ends of the supporting structure in the direction of the channel, the pressure applying device can be placed onto the channel.

The thickness of the channel is irrelevant in this arrangement. The other ends are pivotally mounted on the apparatus's framework.

Advantageously, the actuating lever is connected to the fulcrum pin of the pressure applying device. This makes it possible for the pressure applying device to be directly set in motion with the actuating lever, the lever enabling a relatively large transmission (geometry) ratio to be accomplished for the deformation forces so that the force needing to be exerted on the actuating lever is relatively low.

In a simple variant provision is made for the supporting structure to be pivoted by shifting the actuating lever downwards. Using a subsequent pivoting motion of the actuating lever relative to the supporting structure, the pressure applying device is caused to rotate. The advance travel of the supporting structure from its inoperative position until its engagement with the channel to be deformed is thus caused by pressing the actuating lever down. As soon as the pressure applying device engages the channel to be deformed, the actuating lever is pivoted, causing the channel to be deformed with a high force. Considering that the supporting structure is not advanced by a pivoting motion of the actuating lever but rather by a downward motion of the actuating lever, the full pivotal range of the actuating lever is available for rotating the pressure applying device. It should thus be noted that the pressure applying device is suitable for operation on a narrow channel and a wide channel alike over the same pivot angle.

The framework of the apparatus is preferably equipped with a return stop device for the supporting structure. When the supporting structure is deflected out of its inoperative position until the pressure applying device engages the channel, the return stop device operates to hold the supporting structure in this position.

Advantageously, the return stop device is springloaded in the working direction of the supporting structure, hence following the motion of the supporting structure promptly as the supporting structure is pivoted out of its inoperative position. Thus, the supporting structure is securely held in any swung-out position, that is, in any intermediate position. In this manner the pivotal motion of the supporting structure, that is, the lowering of the pressure applying device to the channel to be deformed, may also take place in a number of steps.

In a preferred embodiment provision is made for the return stop device to be formed by a wheel mounted on the framework for rotation and having a circumferential surface extending in spiral form. As soon as the supporting structure is moved out of an inoperative position, the wheel of the return stop device rotates such that the spiral-shaped circumferential surface is caused to follow the movement of the supporting structure as a result of which the supporting structure continues to be in engagement with the wheel, the wheel preventing it from swinging back. Appropriate means are provided to prevent the wheel from rotating back automatically.

According to a preferred embodiment, the pressure applying device includes a pressure plate and an eccentric shaft bearing on the pressure plate. This arrangement produces in a simple manner a transmission mechanism so that the force exerted through the actuating lever to the pressure plate is materially enhanced by the eccentric shaft. In this arrangement, the pressure plate is pivotally hinged to the framework of the apparatus, and the eccentric shaft bears on the free end of the pressure plate. This has the substantial advantage that the pressure plate is pivoted over a small angle only and that the area of the pressure plate bearing on the channel executes nearly a parallel displacement. It is irrelevant in this arrangement how far the actuating lever is pivoted, that is, how far the eccentric shaft is turned.

In a further aspect, the pressure applying device may be equipped with a unit for opening U-shaped channels. This unit includes a tapered rail capable of being forced between the two legs of the U-shaped channel. This unit is attachable to the pressure applying device as necessary, so that it is operable by means of the actuating lever as well.

A simple and positionally accurate placement of the U-shaped channel into the binding apparatus is obtained in that the support has a locating groove for receiving the U-shaped channel. The channel can be inserted in this locating groove in the correct position relative to the pressure plate. It is thereby ensured that in the operation of the binding apparatus the channel is deformed in the desired manner and the sheets are bound accurately.

In a still further aspect, the locating groove and/or the pressure applying device could have projections by means of which at least sections of the legs of the U-shaped channel are deformed in the direction of the sheets. These projections serve to deform the legs of the U-shaped channel in such a fashion as to produce corresponding projections on these legs which bury themselves in the sheets to be bound, holding them together securely.

Further features, advantages and details of the present invention will become apparent from the claims and the subsequent description setting out in detail a particularly preferred embodiment with reference to the accompanying drawings. It will be understood that any single feature and any combination of single features referred to in the description and the claims and represented by illustration may be essential to the present invention.

DESCRIPTION OF THE PREFERRED EMBODIMENTS

Figure 1:
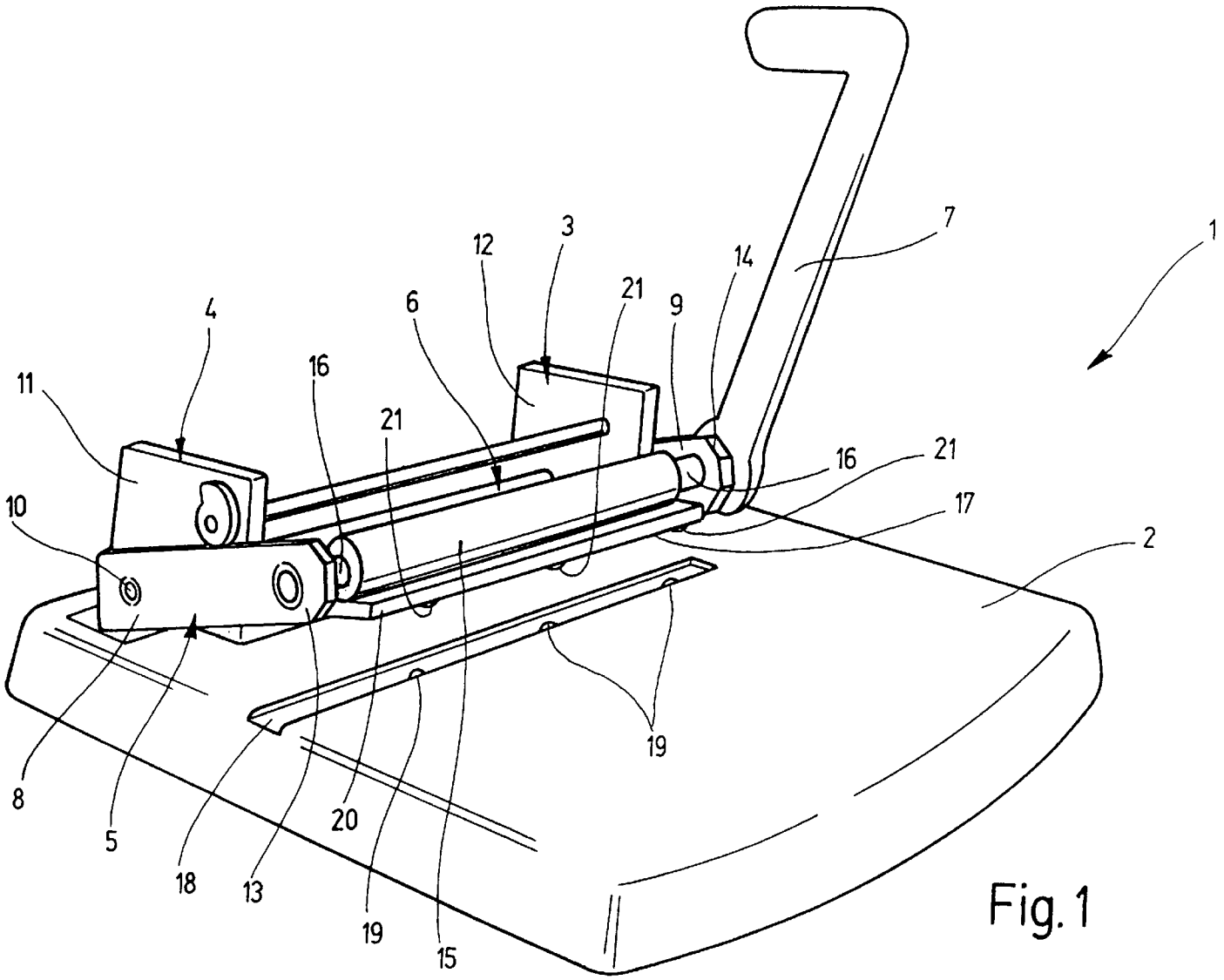
FIG. 1 is a perspective view of the apparatus of the present invention in its inoperative position.

The binding apparatus illustrated in FIG. 1 and generally designated by reference numeral 1 possesses a baseplate 2 on which a framework 3 is mounted. This framework 3 is comprised of a U-shaped frame member 4 to which a supporting structure 5 incorporating a pressure applying device 6 is fixed. The pressure applying device 6 in turn is connected to an actuating lever 7. Conventionally, the frame member 4, the supporting structure 5 and the pressure applying device 6 are covered by a hood (not shown in the drawing) from which only the actuating lever 7 protrudes laterally.

The supporting structure 5 includes two pivot levers 8, 9 having one of their ends secured to a pivot pin 10 for pivoting motion. This pivot pin 10 is held by two brackets 11 and 12 of the frame member 4. The pressure applying device 6 is mounted on the two other free ends 13 and 14.

The pressure applying device 6 includes an eccentric shaft 15 mounted on the free ends 13 and 14 for rotating motion by means of journals 16. Moreover, the journal 16 on the side facing away from the viewer is connected to the actuating lever 7 in a manner preventing relative rotation. Beneath the eccentric shaft 15 is a pressure plate 17 which is pivotally mounted on the frame member 4, particularly on the pivot pin 10. The eccentric shaft 15 operates to pivot the pressure plate 17 about the pivot pin 10. The position of the pressure plate 17 illustrated in FIG. 1 represents the inoperative position in which the pressure plate is held in position as by return springs or the like.

As becomes further apparent from FIG. 1, the base-plate 2 has below the pressure applying device 6 a transverse groove 18 with three projections 19 projecting from the groove bottom. Opposite these projections, the free end 20 of the pressure plate 17 has equally three projections 21 pointing in the direction of the projections 19.

Figure 2:
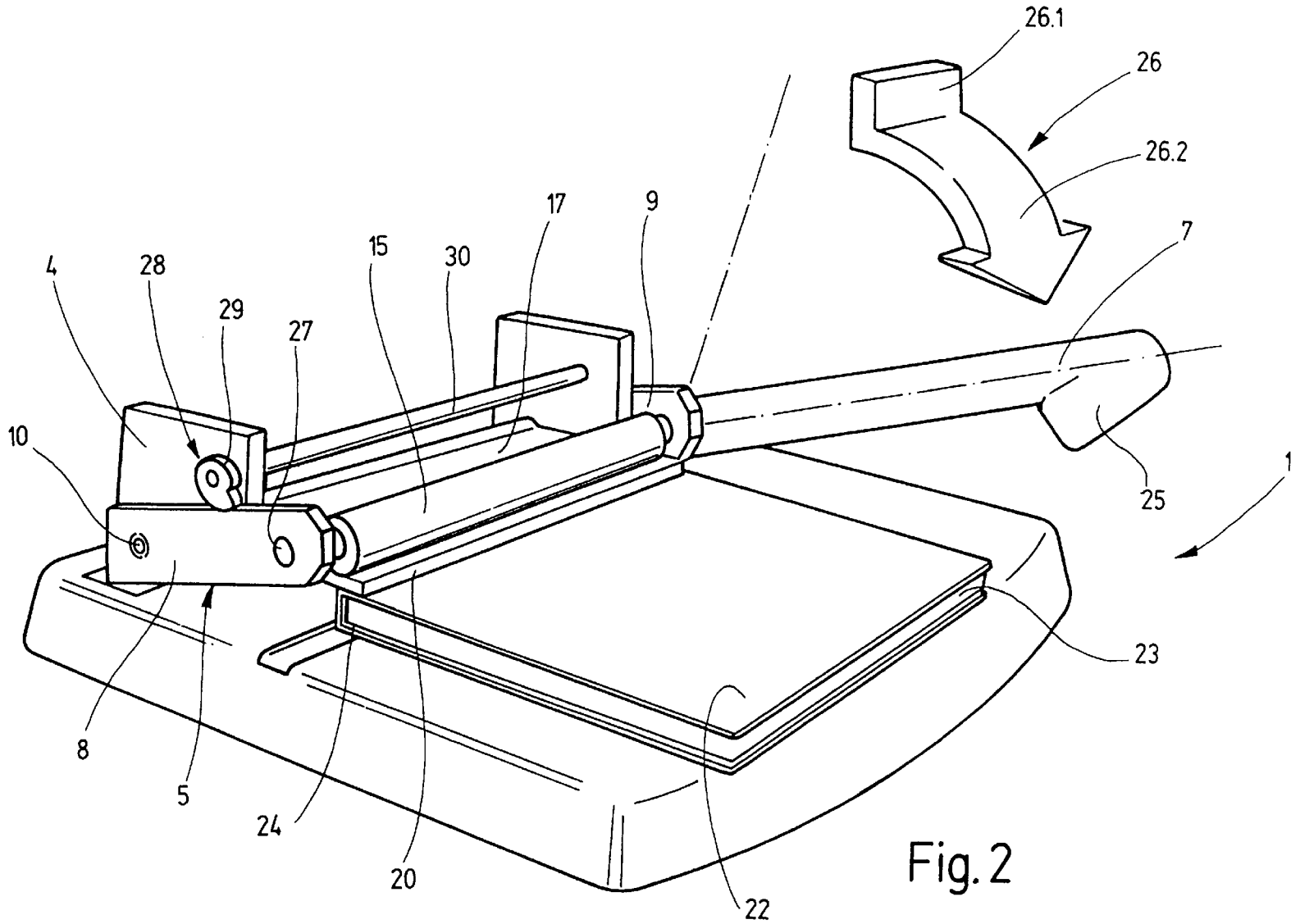
FIG. 2 is a perspective view of the apparatus in its operative position.

FIG. 2 illustrates the operative position of the binding apparatus 1. In this position, the spine area of a book cover 22 with a paper stack 23 sandwiched therein is inserted into the groove 18. This spine area of the book cover 22 accommodates a U-shaped, plastically deformable channel 24 shown only in rough outline which embraces the lateral edges of the paper stack 23. After the book cover 22 with the paper stack 23 sandwiched in it and inserted in the channel 24 is placed into the binding apparatus 1 as illustrated in FIG. 2, the actuating lever 7 is first brought down vertically by its handle 25, as shown by a first section 26.1 of the arrow 26. This downward movement of the actuating lever 7 causes the supporting structure 5 to be pivoted about the pivot pin 10 until the free end 20 rests on the upper side of the book cover 22. In this manner the binding apparatus 1, meaning the pressure applying device 6, is accurately adjusted to accommodate different widths of book covers 22 or channels 24.

Then the actuating lever 7 is pivoted in the direction of a section 26.2 of the arrow 26 about the fulcrum pin 27 of the eccentric shaft 15, whereby the eccentric shaft 15 is rotated. The eccentric shaft 15 is arranged such that in its inoperative position shown in FIG. 1 the distance of the pressure plate 17 to the fulcrum pin 27 is at a minimum. By pivoting the actuating lever 7, the pressure plate 17 is continuously moved away from the fulcrum pin 27 and pressed onto the book cover 22 and the channel 24, causing the two legs of the channel 24 to be compressed, which then clamp between them the sheets of the paper stack 23 sandwiched therebetween. The channel 24 has inwardly protruding projections which are supported by the projections 19 and 21, so that the projections protrude inwardly also in the compressed position of the channel 24, securing the paper stack 23.

Serving to secure the supporting structure 5 in the position illustrated in FIG. 2, that is, the two pivot levers 8 and 9 in their swung out position, is a return stop device 28 which prevents the supporting structure 5 from returning to its inoperative position illustrated in FIG. 1. This is accomplished in that a wheel 29 with a spiral-shaped circumferential surface is rotated in a clockwise direction so that the wheel 29 engages at all times the upper side of the pivot lever 8, preventing it from swinging back. The wheel 29 is mounted on an end of a shaft 30 carried by the frame member 4. At the other end of the shaft 30 is likewise a corresponding wheel which secures the pivot lever 9 in the swung-out position. The wheels 29 are biased in the circumferential direction by a spring (Not shown) so that the wheels 29 follow the pivoting motion of the pivot levers 8 and 9 automatically, being maintained in engagement therewith at all times.

After compression of the channel 24 is completed, the actuating lever 7 is swung back to its initial position in opposition to the arrow section 26.2. This removes the load from the supporting structure 5, enabling the return stop device 28 to be turned back either manually, automatically spring loaded or by motor power so that the supporting structure 5 is in a position to swing back into its initial position shown in FIG. 1.

Figure 3:
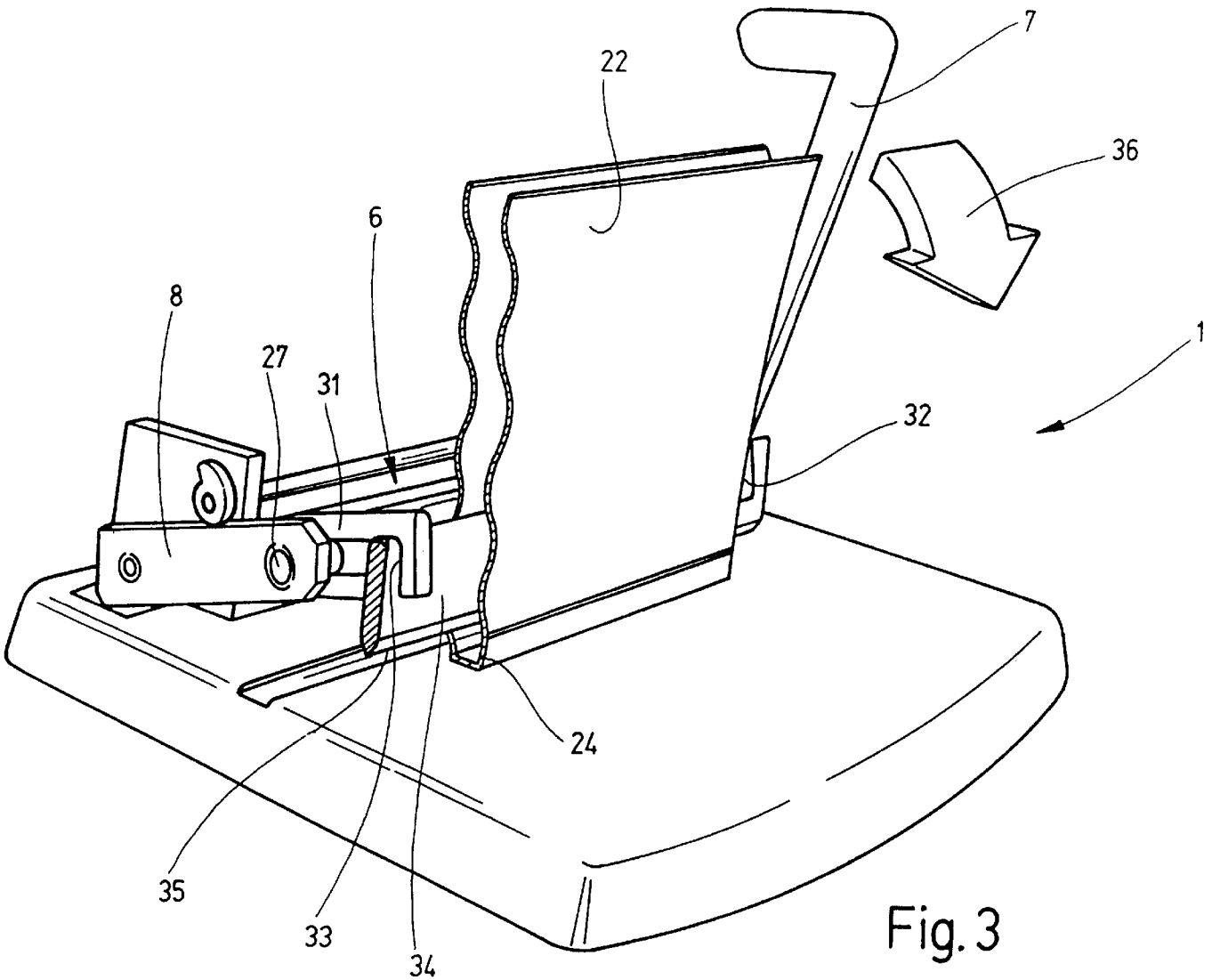
FIG. 3 is a perspective view of the apparatus illustrating the instant a U-shaped channel is being opened.

FIG. 3 shows the binding apparatus 1 as the channel 24 is being opened to allow removal of the paper stack 23. For this purpose, the pressure applying device 6 is equipped with two retaining members 31, 32 which are slipped onto the fulcrum pin 27 and are connected to the pivot levers 8 and 9. The retaining members 31 and 32 include mounting slots 33 adapted to receive therein a tapered rail 34. This tapered rail 34 has a tapered blade 35 which, using a pivoting motion of the actuating lever 7 in the direction of the arrow 36, can be forced between the sheets of a paper stack into the interior of the channel 24. As a result, the channel 24 opens, so that after the actuating lever 7 is pivoted back into its initial position and the tapered rail 34 is withdrawn from the paper stack, the individual sheets can be removed from the book cover 22 and hence from the channel 24.

What is claimed is:

1. An apparatus for binding a number of sheets forming a stack along one of their edges using an essentially U-shaped deformable channel, the apparatus comprising:

support means for depositing, horizontally, the sheets to be bound with the deformable channel;

a pivotal support structure; and a pressure applying device mounted for pivotal movement to said pivotal support structure and as mounted situated above said support means, said pressure applying device including an actuating lever for operating said pressure applying device and said pivotal support structure, wherein said actuating lever also serving to move said pressure applying device from an inoperative position to an operative position for deforming the deformable channel.

2. The apparatus as defined in claim 1, wherein said support structure includes spaced apart free pivotal ends, and wherein said pressure applying device is mounted to said spaced apart free pivotal ends.

3. The apparatus as defined in claim 1, wherein said pressure applying device includes a fulcrum pin, and wherein said actuating lever is connected to said fulcrum pin.

4. The apparatus as defined in claim 1, wherein said support structure is pivoted by shifting of said actuating lever.

5. The apparatus as defined in claim 1, wherein said pressure applying device is rotated by a pivoting motion of said actuating lever relative to said support structure.

6. The apparatus as defined in claim 1, further comprising:

a framework for said support structure said framework having a return stop device for said support structure.

7. The apparatus as defined in claim 6, wherein said operative position and said inoperative position define a working direction, and wherein said return stop is spring-loaded in said working direction.

8. The apparatus as defined in claim 6, wherein said return stop comprises a wheel having a circumferential surface extending in a spiral form, said wheel being mounted on said framework.

9. The apparatus as defined in claim 1, wherein said pressure applying device includes a pressure plate and an eccentric shaft which bears on said pressure plate.

10. The apparatus as defined in claim 9, further comprising:

a framework for said support structure, wherein said pressure plate is pivotally hinged to said framework.

11. The apparatus as defined in claim 9, wherein said pressure plate has a free end, and wherein said eccentric shaft bears on said free end.

12. The apparatus as defined in claim 1, further comprising:

a unit for opening U-shaped channels, said unit being attachable to said pressure applying device.

13. The apparatus as defined in claim 12, wherein said unit includes a tapered rail.

14. The apparatus as defined in claim 1, wherein said support means has a locating groove for receiving the U-shaped channel.

15. The apparatus as defined in claim 14, wherein said locating groove has projections by means of which at least sections of the legs of the U-shaped channel are deformed in the direction of the sheets.

16. The apparatus as defined hi claim 14, wherein said pressure applying device has projections by means of which at least sections of the legs of the U-shaped channel are deformed in the direction of the sheets.

17. The apparatus as defined in claim 14, wherein said locating groove and said pressure applying device have projections by means of which at least sections of the legs of the U-shaped channel are deformed in the direction of the sheets.

* * * * *